US011180716B2

(12) United States Patent
Jaynes et al.

(10) Patent No.: US 11,180,716 B2
(45) Date of Patent: Nov. 23, 2021

(54) CLEANING FORMULATION COMPRISING A SOLVENT ADDITIVE

(71) Applicant: Croda, Inc., Edison, NJ (US)

(72) Inventors: Bingham Scott Jaynes, New City, NY (US); Xin Chen, Hockessin, DE (US); Li Chen, Upper Chichester, PA (US); Mei-Ly Chua, Levittown, PA (US); Joseph William Scheblein, Flemington, NJ (US); Gregory Howard Smith, West Chester, PA (US)

(73) Assignee: Croda, Inc., Plainsboro, NJ (US)

( * ) Notice: Subject to any disclaimer, the term of this patent is extended or adjusted under 35 U.S.C. 154(b) by 8 days.

(21) Appl. No.: 16/632,718

(22) PCT Filed: Jul. 18, 2018

(86) PCT No.: PCT/US2018/042656

§ 371 (c)(1),
(2) Date: Jan. 21, 2020

(87) PCT Pub. No.: WO2019/023016

PCT Pub. Date: Jan. 31, 2019

(65) Prior Publication Data

US 2021/0054309 A1 Feb. 25, 2021

Related U.S. Application Data

(60) Provisional application No. 62/538,052, filed on Jul. 28, 2017.

(51) Int. Cl.

| | |
|---|---|
| ***C11D 1/74*** | (2006.01) |
| ***C11D 3/20*** | (2006.01) |
| ***B08B 3/08*** | (2006.01) |
| ***C11D 3/43*** | (2006.01) |
| ***C11D 11/00*** | (2006.01) |
| ***C11D 17/00*** | (2006.01) |

(52) U.S. Cl.
CPC ..... *C11D 3/2093* (2013.01); *B08B 3/08* (2013.01); *C11D 3/43* (2013.01); *C11D 11/0023* (2013.01); *C11D 17/0017* (2013.01)

(58) Field of Classification Search
CPC ..... C11D 1/667; C11D 1/74
USPC ..... 510/421
See application file for complete search history.

(56) References Cited

U.S. PATENT DOCUMENTS

| | | | | |
|---|---|---|---|---|
| 7,871,971 | B1 * | 1/2011 | Koester | C11D 1/825 510/218 |
| 7,915,435 | B2 | 3/2011 | Gray et al. | |
| 2003/0171244 | A1 * | 9/2003 | Schmid | B01J 2/02 510/421 |
| 2007/0066504 | A1 * | 3/2007 | Hsu | C11D 1/74 510/276 |
| 2007/0287654 | A1 * | 12/2007 | Hsu | C11D 1/667 510/488 |

FOREIGN PATENT DOCUMENTS

| | | | | |
|---|---|---|---|---|
| DE | 10114172 | A1 | 9/2002 | |
| JP | 2005154317 | A | 6/2005 | |
| JP | 2005240015 | A | 9/2005 | |
| WO | 9403251 | A1 | 2/1994 | |
| WO | 9623049 | A1 | 8/1996 | |
| WO | 9629389 | A1 | 9/1996 | |
| WO | WO-02077140 | A1 * | 10/2002 | C11D 1/825 |
| WO | 2013033071 | A1 | 3/2013 | |

OTHER PUBLICATIONS

International Search Report and Written Opinion for International Application No. PCT/US2018/042656, dated Sep. 26, 2018, 10 pages.
International Preliminary Report on Patentability and Written Opinion for International Application No. PCT/US2018/042656, dated Jan. 28, 2020, 6 pages.

* cited by examiner

*Primary Examiner* — Gregory E Webb
(74) *Attorney, Agent, or Firm* — RatnerPrestia

(57) ABSTRACT

A cleaning formulation has from 10 to 99 wt % water, from 0.8 to 40 wt % surfactant, optionally other additives, and from 0.2 to 20 wt % of a solvent additive of formula (I):

$$R^1—O-(AO)_n—C(=O)—R^2 \quad (I)$$

where $R^1$ is $C_3$ to $C_{12}$ alkyl, AO is an alkylene oxide group selected from an ethylene oxide group, a propylene oxide group and a butylene oxide group. At least one AO group in the solvent additive is an ethylene oxide group. The solvent additive has a water solubility of less than 1 wt % in deionised water at 20° C. and the surfactant enables the solvent additive to dissolve and/or disperse in the cleaning formulation. In a method of cleaning an oily or waxy soil from a hard surface, the solvent additive is applied to the hard surface and optionally rinsed with water. The solvent additive is used in a cleaning formulation to improve the percentage soil removal.

14 Claims, No Drawings

CLEANING FORMULATION COMPRISING A SOLVENT ADDITIVE

This application is related, and claims the benefit of priority of, U.S. Provisional Application No. 62/538,052, titled CLEANING FORMULATION COMPRISING A SOLVENT ADDITIVE, filed on 28 Jul. 2017, the contents of which is incorporated herein by reference in its entirety for all purposes.

FIELD OF THE INVENTION

The present invention relates to a solvent additive, use of the solvent additive, a cleaning formulation (or composition) comprising the solvent additive and a method of hard surface cleaning which uses the solvent additive.

BACKGROUND OF THE INVENTION

An objective in making a cleaning formulation is for it to be effective at cleaning a range of different types of soils, including for example oily or waxy soils. A component of a cleaning formulation which has low solubility in water and which has high affinity for oily or waxy soils (e.g. is hydrophobic) may be known as a solvent additive i.e. it is a solvent for oily or waxy soils.

In a cleaning formulation, there is a balance to be struck between effectiveness in removing soils, inertness to the underlying substrate to be cleaned, and convenience and safety of the user. More recently, there has been a considerable interest in developing environmentally friendly cleaning formulations as well.

While no single definition of "environmentally friendly" exists, it is generally accepted that materials derived from biorenewable resources are sustainable for the environment. Moreover, in some countries, percent by weight volatile organic content (VOC) limits are being regulated. For example, the California Air Resources Board (CARB) requires VOC content in general purpose cleaners to be at most 0.5 percent by weight. In this context, VOCs are those carbon compounds with a vapor pressure greater than 0.1 mm Hg at 20° C. Known solvent additives may have a vapor pressure greater than 0.1 mm Hg at 20° C. and therefore be classed as VOCs.

A need exists for cleaning formulations which have one or more of the following properties: non-hazardous, effective at cleaning, non-damaging to the substrate being cleaned, environmentally friendly.

SUMMARY OF THE INVENTION

Surprisingly the applicant has found that a cleaning formulation comprising a new solvent additive addresses one or more of the problems or needs described above.

Viewed from a first aspect, the present invention provides a cleaning formulation comprising:

a. from 10 to 99 wt % water;
b. from 0.8 to 40 wt % surfactant;
c. optionally, other additives; and
d. from 0.2 to 20 wt % of a solvent additive of formula (I):

$$R^1—O-(AO)_n—C(=O)—R^2 \quad (I)$$

wherein:

$R^1$ is $C_3$ to $C_{12}$ alkyl;

AO is an alkylene oxide group wherein each AO is independently selected from an ethylene oxide group, a propylene oxide group and a butylene oxide group and wherein at least one AO group is an ethylene oxide group;

n is from 1 to 9;

$R^2$ is $C_6$ to $C_{13}$ alkyl or alkenyl; and wherein the solvent additive has a water solubility of less than 1 wt % in deionised water at 20° C. and wherein the surfactant enables the solvent additive to dissolve and/or disperse in the cleaning formulation.

Viewed from a second aspect the present invention provides a method of hard surface cleaning comprising the steps:

a. applying a solvent additive of formula (I) according to the first aspect of the invention to a hard surface; and
b. cleaning an oily and/or waxy soil from the hard surface using the solvent additive; and
c. optionally, rinsing the hard surface with water.

Viewed from a third aspect the present invention provides the use of a solvent additive of formula (I) according to the first aspect of the invention in a cleaning formulation to improve the Percentage Soil Removal (% S.R.), measured as defined herein, of an oily and/or waxy soil from a hard surface by the cleaning formulation when compared with the Percentage Soil Removal of an equivalent cleaning formulation which does not comprise a solvent additive.

Viewed from a fourth aspect the present invention provides the use in a cleaning formulation of a combination of:

a. an alcohol ethoxylate fatty acid ester comprising the reaction product of a $C_4$ to $C_8$ alcohol, 1 to 9 mols of ethylene oxide and a $C_8$ to $C_{12}$ fatty acid; and
b. an alcohol ethoxylate comprising the reaction product of a $C_6$ to $C_{14}$ alcohol and 1 to 12 mols of ethylene oxide;

wherein the alcohol ethoxylate fatty acid ester has a water solubility of less than 1 wt % in deionised water at 20° C. and the alcohol ethoxylate improves the dispersion and/or dissolution of the alcohol ethoxylate fatty acid ester in the cleaning formulation.

Any aspect of the invention may include any of the features described herein with regard to that aspect of the invention or any other aspects of the invention.

DETAILED DESCRIPTION OF THE INVENTION

It will be understood that any upper or lower quantity or range limit used herein may be independently combined.

When used herein, it will be understood that the term "wt %" refers to the percentage by weight of the specified component on the basis of the total weight of the specified entity which the component is part of.

The term "group" as used herein means a part of a molecule.

It will be understood that, when describing the number of carbon atoms in a substituent group (e.g. 'C1 to C6'), the number refers to the total number of carbon atoms present in the substituent group, including any present in any branched groups. Additionally, when describing the total number of carbon atoms in, for example fatty acids, this refers to the total number of carbon atoms including the one at the carboxylic acid, and any present in any branch groups.

The term "solvent additive" as used herein should be understood to refer to a compound which has low solubility in water, in the absence of other compounds (e.g. in the absence of a co-surfactant). A solvent additive may be effective in cleaning grease, oil, fat or wax from a substrate due to being more soluble in these compounds than in water i.e. the solvent additive is lipophilic or hydrophobic. For example the solvent additive of the invention may have a water solubility of less than 1 wt % (equivalent to 10 g/1000 g or 10,000 ppm) in deionised water at 20° C. This should be contrasted with, and would not include, a compound which has a solubility in deionised water in the absence of other compounds of greater than 1 wt % at 20° C. A compound which has a solubility in deionised water in the absence of other compounds of greater than 1 wt % at 20° C. may be described as a surfactant (surface active agent) instead of a solvent additive.

The term "hard surface(s)" as used herein should be understood as referring to solid surfaces, particularly but not exclusively to non-porous surfaces such as those of metals, ceramics, glass, wood, and plastics, particularly laminated plastics, all including painted, varnished, sealed or coated surfaces. This should be contrasted with, and would not include, other surfaces, particularly soft and absorbent surfaces such as textiles (cleaned in laundry cleaning) and skin (as in cosmetics, more particularly cosmetic removers).

Examples of hard surfaces include: walls, floors, windows, mirrors, doors, tiles and tiled areas, work surfaces, including cutting and chopping boards, domestic fittings e.g. shelves and cupboards, washing and sanitary fixings e.g. sinks, wash basins, baths, showers and WCs, domestic appliances e.g. stoves, ovens, including microwave ovens, washing machines and dryers, dishwashers, refrigerators, freezers and chillers, food preparation machines e.g. mixers, blenders and food processors, in both domestic and institutional and industrial environments, including in hospitals, medical laboratories and medical treatment environments.

Many (or all) of the chemicals which may be used to produce the solvent additive (or other component) of the present invention are obtained from natural sources. Such chemicals typically include a mixture of chemical species due to their natural origin. Due to the presence of such mixtures, various parameters defined herein can be an average value and may be non-integral.

Solvent Additive

The solvent additive of the invention may comprise the reaction product of an alcohol, a carboxylic acid and an alkylene oxide, preferably ethylene oxide. The solvent additive may consist of the reaction product of an alcohol, a carboxylic acid and an alkylene oxide, preferably ethylene oxide. The solvent additive may consist of the reaction product of a mono-alcohol, a mono-carboxylic acid and an alkylene oxide, preferably ethylene oxide. The solvent additive may be an alcohol ethoxylate fatty acid ester. The solvent additive may not be a partial ester. The solvent additive may not comprise a free (i.e. unreacted) hydroxyl group. The solvent additive may not comprise a free (i.e. unreacted) carboxylic acid group. The solvent additive may be fully esterified. The solvent additive may be a mono-ester i.e. the solvent additive may have only 1 ester bond.

The solvent additive may comprise at least 10 carbon atoms in total, preferably at least 12, more preferably at least 14, typically at least 16, particularly at least 18. The solvent additive may comprise at most 40 carbon atoms in total, preferably at most 38, more preferably at most 36, typically at most 34, particularly at most 32. Preferably the total number of carbon atoms in the solvent additive is from 16 to 36. This number of carbon atoms may be advantageous by being large enough to lower the vapour pressure of the solvent additive so that it is not considered as a volatile organic compound (VOC) while also being small enough to allow the solvent additive to penetrate an oily and/or waxy soil. Penetration of the oily and/or waxy soil may improve the cleaning effect of the solvent additive.

Preferably the solvent additive has a vapour pressure at 20° C. of less than 0.1 mm Hg, more preferably less than 0.05 mm Hg, particularly less than 0.01 mm Hg. Preferably the solvent additive is not considered as a volatile organic compound (VOC).

The solvent additive may have a boiling point under atmospheric pressure of at least 100° C., preferably at least 150° C., particularly at least 200° C. The boiling point may be at most 400° C. The solvent additive may have a flash point under atmospheric pressure of at least 100° C., preferably at least 150° C., particularly at least 180° C. The flash point may be at most 300° C.

The solvent additive is preferably derived from renewable and/or bio-based sources. The level of this may be determinable by ASTM D6866 as a standardised analytical method for determining the bio-based content of samples using $^{14}C$ radiocarbon dating. ASTM D6866 distinguishes carbon resulting from bio-based inputs from those derived from fossil-based inputs. Using this standard, a percentage of carbon from renewable sources can be calculated from the total carbon in the sample.

Preferably, the solvent additive has a renewable carbon content of at least 50 wt %, more preferably at least 75 wt %, particularly at least 90 wt %, desirably 100 wt % when determined using ASTM D6866. A high renewable carbon content may be advantageous in improving the environmental profile of a cleaning formulation comprising the solvent additive.

The solvent additive may have an acid value of at most 50 mg KOH/g, preferably at most 30 mg KOH/g, particularly at most 20 mg KOH/g, desirably at most 15 mg KOH/g, especially at most 10 mg KOH/g. A low acid value may improve the compatibility of the solvent additive in a cleaning formulation.

The solvent additive may have a hydroxyl value of at most 50 mg KOH/g, preferably at most 30 mg KOH/g, particularly at most 20 mg KOH/g, desirably at most 15 mg KOH/g, especially at most 10 mg KOH/g. A low hydroxyl value may improve the compatibility of the solvent additive in a cleaning formulation.

The solvent additive may have a Gardner colour, measured according to ASTM D1544, of at most 7, preferably at most 5, particularly at most 3.

The solvent additive may have a water solubility in deionised water at 20° C., in the absence of other compounds, of less than 1 wt %, preferably less than 0.5 wt %, more preferably less than 0.25 wt %, particularly less than 0.1 wt %, desirably less than 0.05 wt %. The solvent additive may have a water solubility in deionised water at 20° C., in the absence of other compounds, of at least 0.001 wt %, preferably at least 0.005 wt %. Such a low water solubility may make the solvent additive effective at dissolving greases, oils, fats and/or waxes. This low water solubility may cause the solvent additive to be a non-surfactant (i.e. the solvent additive has no significant surfactant surface activity at an oil/water interface since it is mostly dissolved in the oil phase). Preferably the solvent additive is a non-surfactant. The solvent additive may require a co-surfactant, preferably a non-ionic co-surfactant, to be present in an aqueous cleaning formulation, to prevent the solvent additive from phase separating out of the aqueous cleaning formulation.

The solvent additive may be of formula (I):

$$R^1—O\text{-}(AO)_n—C(=O)—R^2 \quad (I)$$

wherein:

$R^1$ is $C_3$ to $C_{12}$ alkyl;

AO is an alkylene oxide group wherein each AO is independently selected from an ethylene oxide group, a propylene oxide group and a butylene oxide group and wherein at least one AO group is an ethylene oxide group;

n is from 1 to 9;

$R^2$ is $C_6$ to $C_{13}$ alkyl or alkenyl.

Preferably $R^1$ is $C_4$ to $C_{12}$ alkyl, more preferably $C_4$ to $C_{10}$ alkyl, particularly $C_4$ to $C_8$ alkyl, desirably $C_4$ or $C_8$ alkyl, especially $C_4$ alkyl.

Preferably at least two AO groups are ethylene oxide groups, more preferably at least 3, particularly at least 4, desirably at least 5, especially at least 6. Preferably all of the alkylene oxide groups in the solvent additive are ethylene oxide groups.

Preferably n is at least 2, more preferably at least 3. Preferably n is at most 8, more preferably at most 7, possibly at most 5. Preferably n is from 3 to 7.

Preferably $R^2$ is $C_7$ to $C_{13}$ alkyl or alkenyl, more preferably $C_7$ to $C_{11}$ alkyl or alkenyl, particularly $C_7$ to $C_{11}$ alkyl, desirably $C_7$ to $C_9$ alkyl, especially $C_8$ alkyl.

Alcohol

The alcohol used to make the solvent additive, and which in one embodiment provides the radical $R^1$ in formula (I), has at least 3 carbon atoms, preferably at least 4 carbon atoms. The alcohol has at most 12 carbon atoms, preferably at most 10, more preferably at most 8, yet more preferably at most 6, particularly preferably at most 4. Preferably the alcohol has 4 carbon atoms.

Preferably the alcohol has only 1 hydroxyl group i.e. is a mono-alcohol. The hydroxyl group may be the only functional group on the alcohol. The alcohol may be linear, branched or a mixture of the two. Preferably the alcohol is linear. The alcohol may be a fatty alcohol.

The alcohol may be selected from propyl alcohol, butyl alcohol, pentyl alcohol, hexyl alcohol, heptyl alcohol, octyl alcohol, nonyl alcohol, decyl alcohol, undecyl alcohol, lauryl alcohol and mixtures thereof, preferably selected from butanol, hexanol and octanol, particularly butanol or octanol, especially butanol. The alcohol may be selected from isopropyl alcohol, isobutyl alcohol, isohexyl alcohol, ethylhexyl alcohol and mixtures thereof. The alcohol may be selected from isobutyl alcohol and butanol.

Preferably, the alcohol has a renewable carbon content of at least 50 wt %, more preferably at least 75 wt %, particularly at least 90 wt %, desirably of about 100 wt % when determined using ASTM D6866.

Carboxylic Acid

The carboxylic acid used to make the solvent additive has at least 7 carbon atoms e.g. equivalent to an $R^2$ radical with at least 6 carbon atoms in one embodiment. The carboxylic acid may have at least 8 carbon atoms, preferably at least 9. The carboxylic acid has at most 14 carbon atoms, preferably at most 12, more preferably at most 11, particularly preferably at most 10, desirably at most 9. Preferably the carboxylic acid has 9 carbon atoms.

Preferably the carboxylic acid has only 1 carboxylic group i.e. is a mono-acid. The carboxylic group may be the only functional group on the acid. The carboxylic acid may be a fatty acid.

The carboxylic acid may be selected from heptanoic acid, octanoic acid, nonanoic acid, decanoic acid, undecanoic acid, lauric acid, tridecanoic acid, myristic acid and mixtures thereof. Preferably the carboxylic acid is selected from octanoic acid, nonanoic acid, decanoic acid and mixtures thereof, more preferably the carboxylic acid is nonanoic acid.

Preferably, the carboxylic acid has a renewable carbon content of at least 50 wt %, more preferably at least 75 wt %, particularly at least 90 wt %, desirably of about 100 wt % when determined using ASTM D6866.

Alkylene Oxide

The solvent additive comprises from 1 to 9 alkylene oxide (AO) groups derived from ethylene oxide (EO), propylene oxide (PO) or butylene oxide (BO), with the total number of groups being equivalent to the index n in the embodiment of formula (I). At least one AO group is an ethylene oxide group.

Preferably the solvent additive comprises at least 2 AO groups, particularly at least 3. Preferably the solvent additive comprises at most 8 AO groups, particularly at most 7 possibly at most 5. Preferably at least two AO groups are ethylene oxide groups, more preferably at least 3, particularly at least 4, desirably at least 5, especially at least 6. Preferably all of the alkylene oxide groups in the solvent additive are ethylene oxide groups.

According to one embodiment, the ethylene oxide groups in the solvent additive are derived from at least one ethylene oxide monomer containing a $^{14}C/^{12}C$ ratio at a level corresponding to a bio-based material, according to standard ASTM D6866. For example the ethylene oxide may be synthesized from ethylene which is itself synthesized from ethanol from a biological source (bioethanol). Bioethanol may be derived from the fermentation of renewable raw materials, in particular vegetable raw materials selected from sugar cane, sugar beet, maple, date palm, sugar palm, sorghum, agave, corn, wheat, barley, sorghum, soft wheat, rice, potato, cassava, sweet potato and algae. Preferably the bioethanol is derived from corn.

Similarly, any propylene oxide or butylene oxide groups in the solvent additive may be derived from at least one propylene oxide or butylene oxide monomer containing $^{14}C$, according to standard ASTM D6866, which is synthesized from propylene or butylene which is itself synthesized from an alcohol or from a mixture of alcohols, said alcohol or mixture of alcohols comprising at least isopropanol and/or at least a mixture of ethanol and of 1-butanol. These alcohols are themselves derivatives of renewable raw materials as mentioned above.

Preferably, the alkylene oxide groups in the solvent additive have a renewable carbon content of at least 50 wt %, more preferably at least 75 wt %, particularly at least 90 wt %, desirably of about 100 wt % when determined using ASTM D6866.

Cleaning Formulation

The cleaning formulation comprises from 10 to 99 wt % water. The cleaning formulation may comprise at least 12 wt % water, preferably at least 20 wt %, more preferably at least 40 wt %, particularly at least 60 wt %, desirably at least 80 wt %, possibly at least 90 wt %. The cleaning formulation may comprise at most 98 wt % water, preferably at most 96 wt %, more preferably at most 94 wt %, particularly at most 92 wt %, possibly at most 90 wt %. Preferably the cleaning formulation comprises from 50 to 95 wt % water.

The cleaning formulation comprises from 0.8 to 40 wt % surfactant. The cleaning formulation may comprise at least 0.9 wt % surfactant, preferably at least 1.2 wt %, more preferably at least 1.6 wt %, particularly at least 2 wt %, desirably at least 6 wt %, possibly at least 8 wt %. The cleaning formulation may comprise at most 35 wt % surfactant, preferably at most 20 wt %, more preferably at most 15 wt %, particularly at most 10 wt %, desirably at most 9 wt %, possibly at most 6 wt %. The surfactant may advantageously increase the solubility of the solvent additive in the cleaning formulation and/or prevent the solvent additive from phase separating out of the cleaning formulation.

The cleaning formulation may comprise at least 2 wt % of an alcohol ethoxylate, preferably at least 4 wt %, more preferably at least 6 wt %, based on the total weight of the cleaning formulation. The cleaning formulation may comprise at most 30 wt % of an alcohol ethoxylate, preferably at most 20 wt %, more preferably at most 15 wt %, particularly at most 10 wt %. The alcohol ethoxylate may advantageously increase the solubility of the solvent additive in the cleaning formulation and/or prevent the solvent additive from phase separating out of the cleaning formulation.

The cleaning formulation comprises from 0.2 to 20 wt % of the solvent additive. The cleaning formulation may comprise at least 0.4 wt % solvent additive, preferably at least 0.6 wt %, more preferably at least 0.8 wt %, particularly at least 1 wt %, desirably at least 1.5 wt %, possibly at least 2 wt %. The cleaning formulation may comprise at most 18 wt % solvent additive, preferably at most 10 wt %, more preferably at most 6 wt %, particularly at most 4 wt %, desirably at most 2 wt %, possibly at most 1.5 wt %.

The solvent additive may have a solubility in the cleaning formulation at 20° C. of at least 0.4 wt %, preferably at least 0.6 wt %, particularly at least 0.8 wt %, desirably at least 1 wt %. The solvent additive may have a solubility in the cleaning formulation at 20° C. of at most 20 wt %, preferably at most 10 wt %, particularly at most 6 wt %, desirably at most 4 wt %.

In the cleaning formulation, the weight ratio of surfactant to solvent additive may be at least 1:2, preferably at least 1:1, particularly at least 2:1, desirably at least 4:1, possibly at least 8:1. The weight ratio of surfactant to solvent additive may be at most 10:1, preferably at most 8:1, particularly at most 6:1, desirably at most 5:1, possibly at most 4:1. Preferably, the weight ratio of surfactant to solvent additive is from 1:2 to 10:1, more preferably from 1:1 to 5:1.

In the cleaning formulation, the weight ratio of other additives (i.e. other additives which are not a surfactant and not a solvent additive) to solvent additive may be at least 1:2, preferably at least 1:1, particularly at least 2:1, desirably at least 3:1, possibly at least 4:1. The weight ratio of other additives to solvent additive may be at most 10:1, preferably at most 8:1, particularly at most 6:1, desirably at most 5:1, possibly at most 4:1.

The cleaning formulation may have a pH of at most 10, preferably at most 9, desirably at most 8. Highly alkaline conditions (greater than pH 10) may undesirably hydrolyze the solvent additive. The cleaning formulation may have a pH of at least 3, preferably at least 4, desirably at least 5.

The cleaning formulation may be a hard surface cleaning formulation. The cleaning formulation may not be a laundry cleaning formulation. The cleaning formulation may not be a skin cleaning formulation.

The cleaning formulation may provide a Percentage Soil Removal, measured as defined herein, of at least 40%, preferably at least 45%, particularly at least 50%. The cleaning formulation may provide a Percentage Soil Removal, measured as defined herein, of at most 95%, preferably at most 90%. The cleaning formulation may provide a Percentage Soil Removal, measured as defined herein, which has a higher value when using a solvent additive of formula (I) when compared with using an equivalent but non-alkoxylated ester solvent additive.

The third aspect of the invention provides the use of a solvent additive of formula (I) in a cleaning formulation to improve the Percentage Soil Removal (% S.R.), measured as defined herein, of an oily and/or waxy soil from a hard surface by the cleaning formulation when compared with the Percentage Soil Removal of an equivalent cleaning formulation which does not comprise a solvent additive e.g. a solvent additive of formula (I).

The % S.R. of the oily and/or waxy soil may be at least two times greater (i.e. at least double), preferably at least 2.5 times greater, particularly at least 3 times greater for the cleaning formulation when compared with an equivalent cleaning formulation which does not comprise a solvent additive of formula (I).

Surfactant

The surfactant may be selected from non-ionic surfactants, anionic surfactants, cationic surfactants, amphoteric surfactants and mixtures thereof, preferably selected from non-ionic surfactants and anionic surfactants, desirably selected from non-ionic surfactants.

The surfactant may be (or comprise) a non-ionic surfactant selected from alcohol ethoxylates, alkylphenol ethoxylates, polysorbates, ethoxylated fatty acids, ethoxylated triglycerides, alkyl polyglucosides, glycerol esters, glycol esters, diethanolamides, monoalkanolamides polyoxyethylene amides and polyoxyalkylene block copolymers. Mixtures of non-ionic surfactants are also contemplated. Preferably the surfactant comprises a non-ionic surfactant, preferably comprises at least one alcohol ethoxylate.

Preferably the surfactant is an alcohol ethoxylate. The alcohol ethoxylate may comprise a C6 to C14 alcohol, preferably a C8 to C10 alcohol. The alcohol ethoxylate may comprise from 1 to 20 mols of ethylene oxide, preferably from 1 to 12 mols, more preferably from 2 to 10 mols, particularly from 2 to 8 mols, desirably from 2 to 6.5 mols. The alcohol ethoxylate may assist the stability or solubility of the solvent additive in water.

The surfactant may be (or comprise) an anionic surfactant selected from carboxylate surfactants, N-acyl sarcosinate surfactants, acylated protein hydrolysate surfactants, sulfonate surfactants, sulfate surfactants, and phosphate ester surfactants. The carboxylate surfactants may include, for example, alkyl carboxylates, alkenyl carboxylates, and polyalkoxy carboxylates. The sulfonate surfactants may include, for example, alkyl sulfonates, aryl sulfonates, and alkylaryl sulfonates. Some examples of contemplated sulfonate surfactants are alkylbenzene sulfonates, naphthalene sulfonates, alpha-olefin sulfonates, petroleum sulfonates, and sulfonates in which the hydrophobic group includes at least one linkage that is selected from ester linkages, amide linkages, ether linkages (such as, for example, dialkyl sulfosuccinates, amido sulfonates, sulfoalkyl esters of fatty acids, and fatty acid ester sulfonates), and combinations thereof. Some contemplated sulfate surfactants include, for example, alcohol sulfate surfactants, ethoxylated and sulfated alkyl alcohol surfactants, ethoxylated and sulfated alkyl phenol surfactants, sulfated carboxylic acids, sulfated amines, sulfated esters, and sulfated natural oils or fats. Some contemplated phosphate ester surfactants are, for example phosphate monoesters and phosphate diesters. Contemplated anionic surfactants have corresponding cations. Contemplated corresponding cations include, for example, sodium, potassium, ammonium, monoethanolamine, diethanolamine, triethanolamine, magnesium cations, and mixtures thereof.

The surfactant may be (or comprise) a cationic surfactant selected from amine surfactants and quaternary ammonium salt surfactants. Contemplated amine surfactants include, for example, primary, secondary, and tertiary alkyl amine surfactants; primary, secondary, and tertiary alkenyl amine surfactants; imidazoline surfactants; amine oxide surfactants; ethoxylated alkylamine surfactants; surfactants that are alkoxylates of ethylene diamine; and amine surfactants where the hydrophobic group contains at least one amide linkage. Contemplated quaternary ammonium salt surfactants include, for example, dialkyldimethylammonium salt surfactants, alkylbenzyldimethylammonium salt surfactants, alkyltrimethylammonium salt surfactants, alkylpyridinium halide surfactants, surfactants made by quaternizing tertiary amine compounds, and esterquats (i.e., surfactants that are quaternary ammonium salts with at least one hydrophobic group that contains an ester linkage). Contemplated quaternary ammonium salt surfactants have corresponding anions. Contemplated corresponding anions include, for example, halide ions (such as, for example, chloride ions), methyl sulfate ions, other anions, and mixtures thereof.

The surfactant may be (or comprise) an amphoteric surfactant selected from alkylbetaine surfactants, amidopropylbetaine surfactants, and surfactants that are derivatives of imidazolinium. Mixtures of contemplated amphoteric surfactants are also contemplated.

Other Additives Optionally, the cleaning formulation comprises other additives (i.e. other additives which are not a surfactant and not a solvent additive). The other additives may be selected from builders, chelators, sequestrants, alkalinity sources, acid sources, buffers, bleaches, dyes, fragrances and preservatives, preferably selected from builders, chelators, buffers and bleaches.

The cleaning formulation may comprise one or more builders (also be known as a detergent builders). A builder may enhance the effectiveness of the surfactant. The builder may comprise one or more species of builder. Examples of suitable builders include phosphates, orthophosphates, polyphosphates such as tetrapotassium pyrophosphate, silicates and/or metasilicates such as sodium metasilicate, and organic builders such as hydroxycarboxylic acids and their water soluble, particularly alkali metal e.g. Na or K, salts, such as citrates e.g. sodium citrate and gluconates, phosphonic acids and phosphonoalkane carboxylic acids and their water soluble particularly alkali metal e.g. Na or K, salts. The cleaning formulation may comprises at least 0.5 wt % builder, preferably at least 1 wt % builder, more preferably at least 2 wt % builder, even more preferably at least 5 wt % builder. The cleaning formulation may comprise at most 30 wt % builder, more preferably at most 20 wt % builder, even more preferably at most 10 wt % builder.

The cleaning formulation may comprise one or more chelators, for example iron and/or manganese chelating agents. Such chelating agents can be selected from the group consisting of gluconates, amino carboxylates, amino phosphonates, polyfunctionally-substituted aromatic chelating agents and mixtures therein. Gluconates useful as chelators include sodium gluconate. Amino carboxylates useful as chelators include ethylenediaminetetraacetates, N-hydroxyethyl-ethylenediaminetriacetates, nitrilotriacetates, ethylenediamine tetraproprionates, triethylenetetraaminehexacetates, diethylenetriaminepentaacetates, and ethanoldiglycines, alkali metal, ammonium, and substituted ammonium salts and mixtures thereof. Amino phosphonates are also suitable for use as chelators. If utilized, these chelators will generally comprise from about 0.1% to about 10% wt % of the cleaning formulation, preferably from about 0.1 wt % to about 3.0 wt %.

The cleaning formulation may comprise one or more alkalinity sources, acid sources, and/or buffers. Suitable buffers include alkali metal salts, preferably alkali metal carbonates or bicarbonates. Preferable buffers include sodium salts, for example sodium bicarbonate. If utilized, these buffers will generally comprise from about 0.1% to about 10% wt % of the cleaning formulation, preferably from about 0.1 wt % to about 3.0 wt %.

The cleaning formulation may comprise a peroxide bleach for example an organic and/or inorganic peroxide or hydrogen peroxide or a source of hydrogen peroxide. The cleaning formulation may comprise at least 1 wt %, preferably at least 2 wt % of bleach, preferably peroxide bleach, and may comprise at most 5 wt % of bleach, preferably peroxide bleach. The cleaning formulation may not comprise a chlorine bleach.

The cleaning formulation may not comprise any optical brighteners.

The cleaning formulation may not comprise any enzymes.

Method of Cleaning

A method of hard surface cleaning according to the second aspect of the invention comprises:

a. applying a solvent additive of formula (I) to a hard surface; and b. cleaning an oily and/or waxy soil from the hard surface using the solvent additive; and c. optionally, rinsing the hard surface with water.

The hard surface may be a non-porous surface. The hard surface may be located on a substrate selected from metals, ceramics, glass, wood, plastics and construction materials. The hard surface may be selected from a painted, varnished, sealed or coated surface. The hard surface may be selected from walls, floors, windows, mirrors, doors, tiles, work surfaces, domestic fittings, washing and sanitary fixings, domestic appliances and food preparation machines.

The oily and/or waxy soil may comprise oils, fats, greases and/or waxes. The oily and/or waxy soil may comprise natural oil, synthetic oil, mineral oil, industrial grease, human grease, animal grease and/or food grease.

Step a. of the method may comprise pouring, spraying or using an application means to apply the solvent additive of formula (I) to the hard surface.

In step a. the solvent additive may be applied in the absence of a cleaning formulation. Preferably in step a. the solvent additive is applied as part of a cleaning formulation as described herein.

Step b. of the method may comprise simultaneously or subsequently spreading and/or wiping the solvent additive of formula (I) over the hard surface, preferably with a fibrous or porous wiping or spreading means.

Optional step c. of the method may comprise removing or rinsing at least part of the solvent additive of formula (I) from the hard surface with water and/or a fibrous or porous drying means.

The Percentage Soil Removal (% S.R.) of the oily and/or waxy soil, measured as defined herein, may be at least two times greater (i.e. at least double), preferably at least 2.5 times greater, particularly at least 3 times greater for the cleaning formulation according to the first aspect of the invention when compared with an equivalent cleaning formulation which does not comprise a solvent additive.

Any or all of the features described herein, and/or any or all of the steps of any method or process described herein, may be used in any combination in any aspect of the invention.

EXAMPLES

The invention is illustrated by the following non-limiting examples.

It will be understood that all tests and physical parameters described herein have been determined at atmospheric pressure and room temperature (i.e. about 20° C.), unless otherwise stated herein, or unless otherwise stated in the referenced test methods and procedures. All parts and percentages are given by weight unless otherwise stated.

Test Methods

In this specification, the following test methods are used. Further test methods are also defined in the following examples:

(i) The acid value is defined as the number of mg of potassium hydroxide required to neutralise the free acid in 1 g of sample, and was measured by direct titration with a standard potassium hydroxide solution.

(ii) The hydroxyl value is defined as the number of mg of potassium hydroxide equivalent to the hydroxyl content of 1 g of sample, and was measured by acetylation followed by hydrolysation of excess acetic anhydride. The acetic acid formed was subsequently titrated with an ethanolic potassium hydroxide solution.

(iii) The saponification (or SAP) value is defined as the number of mg of potassium hydroxide required for the complete saponification of 1 g of sample, and was measured by saponification with a standard potassium hydroxide solution, followed by titration with a standard hydrochloric acid solution.

(iv) The water content was determined by Karl Fischer titration.

Example 1

The process described in this Example 1 is intended to make ethoxylated (3-EO) n-butanol pelargonate through a two-step synthesis process. In Step 1, the molar ratio of n-butanol to ethylene oxide is 1:3. In Step 2, the molar ratio of PEG-3 Butanol to pelargonic ($C_9$) acid is 1.15:1.

TABLE 1

| Raw Material | Wt, g | Wt. % |
|---|---|---|
| n-Butanol | 539 | 35.9 |
| Ethylene Oxide | 961 | 64.1 |

Step 1

The reaction process for Step 1 to make PEG-3 Butanol, using the raw materials listed in Table 1 is as follows. Into a clean and dry 2-L pressurized reactor, charge n-butanol and catalyst (potassium hydroxide pellets, >85%) at ambient temperature. The reactor is sealed and purged with nitrogen sparge. Meantime, the reactor is agitated and heated to 115° C. slowly. Once at temperature, start to feed ethylene oxide (EO). The ethylene oxide feeding rate needs to be controlled so the reactor pressure does not exceed safe limit. Once all the ethylene oxide is added, allow the reactor pressure to decrease at the reaction temperature range of 110-115° C. Hold the reaction for additional 1 hour at reaction temperature. Cool the reactor to 80° C., and pull vacuum to remove the residual ethylene oxide. Cool the reaction further to 60-65° C., pull sample to test pH for neutralization. Calculate and charge lactic acid (Target: pH 6-7) and agitate for 10-15 minutes. Once within pH range, discharge the product into beaker. The product will be referred to as PEG-3 Butanol.

TABLE 2

| Raw Material | Molar ratio | Wt, g | Wt. % |
|---|---|---|---|
| Pelargonic Acid | 1 | 598.35 | 39.89 |
| PEG-3 Butanol (from Step 1) | 1.15 | 901.65 | 60.11 |
| Total | | 1500 | 100 |
| Sodium Hypophosphite | | 1.95 | 0.13 |
| Catalyst: Tetra-n-butyl titanate | | 0.3 | 0.02 |

Step 2

The reaction process for Step 2 to make PEG-3 Butanol Pelargonate using the raw materials listed in Table 2 is as follows. Into a clean and dry 2-L glass reaction vessel, charge pelargonic acid, PEG-3 Butanol and sodium hypophosphite at ambient temperature. Dean-Stark and packed columns are used as reactor overhead set-up. With agitation, heat the reactor to 215° C. slowly; sparge vessel with nitrogen. Once at temperature, hold the reaction at 215° C. for 1 to 2 hours. Charge TBT catalyst with PEG-3 Butanol to the reactor over 5 minutes. Keep heating the reactor slowly from 215° C. to 230° C. Hold the reaction at 230° C. until Acid Value is below 10 mg KOH/g. Cool the reaction to 60-65° C. and discharge the product into beaker. Filter the product. The product will be referred to as Solvent Additive 1 (SA1).

The SA1 product was analysed and the results are given in Table 3.

TABLE 3

| Measurement | Solvent Additive 1 (SA1) |
|---|---|
| Acid Value, mg KOH/g | 4.6 |
| Hydroxyl Number, mg KOH/g | 3.6 |
| SAP Number, mg KOH/g | 147 |
| Karl Fischer water content, wt % | 0.1 |

Example 2

Solvent Additives 2 to 6 (SA2 to SA6) were prepared using a method similar to Example 1. The compositions of SA1 to SA6 are given in Table 4.

TABLE 4

| Sample | Composition | Alcohol | Acid | Alkylene Oxide (mol) |
|---|---|---|---|---|
| SA1 | (C9 acid)$(EO)_3$(n-Bu) | Butanol | Pelargonic | 3 EO |
| SA2 | (C9 acid)$(EO)_5$(n-Bu) | Butanol | Pelargonic | 5 EO |
| SA3 | (C9 acid)$(EO)_{6.5}$(n-octyl) | Octanol | Pelargonic | 6.5 EO |
| SA4 | (C8-C10 acid)$(EO)_3$(n-Bu) | Butanol | C8/10 mix | 3 EO |
| SA5 | (C8-C10 acid)$(EO)_5$(n-Bu) | Butanol | C8/10 mix | 5 EO |
| SA6 | (C12 acid)$(EO)_5$(n-Bu) | Butanol | Lauric | 5 EO |

Example 3

Solvents Additives SA1 to SA6 were tested for solubility in deionised water at 20° C. SA1 to SA6 were added to water and stirred with good agitation for 1 hour. Solution appearance was checked upon standing to see if any cloudiness or separation was observed. All Samples at 0.5 wt % and 0.25 wt % solvent showed cloudiness and solvent layer on surface (i.e. not soluble) and at concentrations of 0.05 wt % undissolved oil type droplet were observed (i.e. not soluble). These solubility results are given in Table 5.

TABLE 5

| Sample | Solvent Additive Concentration in DI water at 20° C. 0.5 wt %/ 5000 ppm | 0.25 wt %/ 2500 ppm | 0.05 wt %/ 500 ppm |
|---|---|---|---|
| SA1 | not soluble | not soluble | not soluble |
| SA2 | not soluble | not soluble | not soluble |
| SA3 | not soluble | not soluble | not soluble |
| SA4 | not soluble | not soluble | not soluble |
| SA5 | not soluble | not soluble | not soluble |
| SA6 | not soluble | not soluble | not soluble |

Example 4

Cleaning formulations were made using solvent additives SA1, SA2, SA3 and SA5 of Examples 1 to 3. The solvent additives were added to an aqueous hard surface cleaning formulation which will be referred to as Cleaning Formulation 1 (CF1). The composition of CF1 is shown in Table 6.

TABLE 6

| Cleaning Formulation 1 (CF1) | % Wt. |
|---|---|
| Deionised Water | Up to 100 |
| Surfactant - NatSurf 265 ex Croda | 2.0 |
| Co-surfactant - Crodateric LIDP ex Croda | 0.5 |
| Chelator - Sodium gluconate | 0.4 |
| Buffer - Sodium bicarbonate | 0.5 |
| Solvent Additive | 0.3 to 2.0 (*) |

(*) The amount of Solvent Additive included in CF1 is the maximum amount soluble in CF1 and is given in Table 7.

Each solvent additive was added to CF1 to the maximum solubility level, i.e. to just before the solution became cloudy, using a method similar to Example 3. This is the maximum solubility for each solvent additive in this cleaning formulation. Maximum solubility levels are shown in Table 7. It can be seen that the solvent additives of the present invention have solubility of at least 0.7 wt % in CF1, while comparative esters butyl pelargonate and 2-ethylhexyl benzoate (both without alkoxylation) have a lower solubility of about 0.3 wt %.

TABLE 7

| Solvent Additive | Max. Solubility of Solvent Additive in CF1 (wt %) |
|---|---|
| SA3 | 2.0 |
| SA2 | 1.5 |
| SA5 | 1.4 |
| SA1 | 0.7 |
| Butyl pelargonate - comparative | 0.3 |
| 2-ethylhexyl benzoate - comparative | 0.3 |

Example 5

The cleaning performance of various solvent additives in Cleaning Formulation 1 (CF1) was tested as follows. An Oily Soil was prepared from the components shown in Table 8 below. Each component was added sequentially with stirring and the mixture was stirred until homogeneous. The soil was a dark opaque liquid that was stirred during use to prevent settling.

TABLE 8

| Oily Soil | % Wt. |
|---|---|
| Odorless Mineral Spirits | 66.8 |
| Carnation Mineral Oil (light) | 2.0 |
| Motor Oil (used) | 4.0 |
| Texas Crude Oil | 12.0 |
| Black Charm Clay | 15.0 |
| Carbon Black | 0.2 |
| Total | 100.0 |

Vinyl floor tiles (Armstrong Imperial texture, cool white pattern #51899) were washed in dilute, mild dish detergent to remove any dust or dirt. After air drying, they were labeled and cut into 2×4 inch sections, with the grain running in the long direction. Since grain direction may affect the evenness of the surface, the tiles were used such that both soil application and scrubbing of the tile were performed along the grain.

To apply the Oily Soil to the tiles, a foam brush was dipped in the stirred soil to wet the foam, and excess soil was removed by pre-wiping on a scrap tile. A clean cut tile was tared on a balance and 0.2 g of soil was then applied with the foam brush on each tile. After drying at room temperature for 1 hour, the tiles were baked at 100° C. for 20 minutes to cure the soil, followed by cooling on a flat surface.

The blends of Cleaning Formulation 1 (CF1)+ Solvent Additive from Tables 6 & 7 of Example 4 were then used to clean the vinyl tiles soiled with the Oily Soil. Cleaning tests were carried out on a Sheen Washability Tester. Damp sponges with tap water were secured in the holders on the Sheen instrument. A soiled vinyl tile prepared as above was treated with cleaning test solution by applying via a spray bottle (6 sprays, complete coverage) on a flat surface. The sprayed solution was allowed to contact the soil for 2 minutes. During the 2 minute dwell time, 2.5 g of test solution was applied to the exposed damp sponge surfaces using a disposable pipette. Treated sponges were then passed over the soiled tiles for twenty cycles with 400 g weights applied on each sponge. Cleaned tiles were removed, rinsed under a gentle stream of tap water, and allowed to dry. Soil removal was then measured by determining L values. The "L" value represents "lightness" on a black to white scale in the description of color using the L*a*b system, where "a" describes the green-red component and "b" describes the blue-yellow. The colorimeter used to determine the L values was a HunterLab LabScan XE.

Results for the test are reported as Percentage Soil Removal (% S.R.). This value is calculated as follows:

$$\% \ S.R. = \frac{L_t - L_s}{L_o - L_s} \times 100$$

Where: $L_t$=average L reading of cleaned or "treated" tile
$L_s$=average L reading of soiled tiles for the batch
$L_o$=average L reading of "original", or unsoiled tiles Percentage Soil Removal results for all the CF1 formulations are shown in Table 9. It can be seen from the % S. R. levels that the solvent additives of the current invention provide cleaning of >53% in all cases. The comparative (non-alkoxylated) ester examples provide cleaning levels of <38%. Cleaning Formulation 1 (CF1) with no solvent additive gave a soil removal value of 15.8%.

TABLE 9

| Solvent Additive in CF1 | Percentage Soil Removal (% S.R.) of CF1 on Oily Soil of Table 8 using Sheen Washability Tester |
|---|---|
| SA3 | 74.9 |
| SA2 | 70.1 |
| SA5 | 60.9 |
| SA1 | 53.2 |
| Butyl pelargonate - comparative | 37.4 |
| 2-ethylhexyl benzoate - comparative | 11.4 |
| CF1 control (with no solvent additive) | 15.8 |

It is to be understood that the invention is not to be limited to the details of the above embodiments, which are described by way of example only. Many variations are possible.

The invention claimed is:

1. A cleaning formulation comprising:

a. from 10 to 99 wt % water;

b. from 0.8 to 40 wt % surfactant;

c. optionally, other additives; and d. from 0.2 to 20 wt % of a solvent additive of formula (I):

$$R^1—O-(AO)_n—C(=O)—R^2 \quad (I)$$

wherein:

$R^1$ is $C_3$ to $C_{12}$ alkyl;

AO is an alkylene oxide group wherein each AO is independently selected from an ethylene oxide group, a propylene oxide group and a butylene oxide group and wherein at least one AO group is an ethylene oxide group;

n is from 1 to 9;

$R^2$ is $C_6$ to $C_{13}$ alkyl or alkenyl;

wherein the total number of carbon atoms in the solvent additive is from 16 to 36; and wherein the solvent additive has a water solubility of less than 1 wt % in deionised water at 20° C. and wherein the surfactant enables the solvent additive to dissolve and/or disperse in the cleaning formulation.

2. A cleaning formulation according to claim 1 wherein $R^1$ is $C_4$ to $C_8$ alkyl.

3. A cleaning formulation according to claim 1 wherein all of the alkylene oxide groups in the solvent additive are ethylene oxide groups.

4. A cleaning formulation according to claim 1 wherein n is from 3 to 7.

5. A cleaning formulation according to claim 1 wherein $R_2$ is $C_7$ to $C_{11}$ alkyl.

6. A cleaning formulation according to claim 1 wherein the weight ratio of surfactant to solvent additive is from 1:2 to 10:1, preferably from 1:1 to 5:1.

7. A cleaning formulation according to claim 1 wherein the surfactant comprises a non-ionic surfactant.

8. A cleaning formulation according to claim 1 comprising from 50 to 95 wt % water.

9. A method of hard surface cleaning comprising the steps of:

a. applying to a hard surface a solvent additive of formula (I):

$$R^1—O-(AO)_n—C(=O)—R^2 \quad (I)$$

wherein:

$R^1$ is $C_3$ to $C_{12}$ alkyl;

AO is an alkylene oxide group wherein each AO is independently selected from an ethylene oxide group, a propylene oxide group and a butylene oxide group and wherein at least one AO group is an ethylene oxide group;

n is from 1 to 9;

$R^2$ is $C_6$ to $C_{13}$ alkyl or alkenyl; and the total number of carbon atoms in the solvent additive is from 16 to 36;

b. cleaning an oily and/or waxy soil from the hard surface using the solvent additive; and c. optionally, rinsing the hard surface with water.

10. A method according to claim 9 wherein in step a. the solvent additive is applied in the absence of a cleaning formulation.

11. A method according to claim 9 wherein in step a. the solvent additive is applied as part of a cleaning formulation according to claim 1.

12. A method according to claim 11 wherein the Percentage Soil Removal (% S.R.) of the oily and/or waxy soil, measured as defined herein, is at least two times greater for the cleaning formulation according to claim 1 when compared with an equivalent cleaning formulation which does not comprise the solvent additive.

13. A solvent additive of formula (I):

$$R^1—O-(AO)_n—C(=O)—R^2 \quad (I)$$

wherein:

$R^1$ is $C_3$ to $C_{12}$ alkyl;

AO is an alkylene oxide group wherein each AO is independently selected from an ethylene oxide group, a propylene oxide group and a butylene oxide group and wherein at least one AO group is an ethylene oxide group;

n is from 1 to 9;

$R^2$ is $C_6$ to $C_{13}$ alkyl or alkenyl;

the total number of carbon atoms in the solvent additive is from 16 to 36;

present in a cleaning formulation, wherein the cleaning formulation improves the Percentage Soil Removal (% S.R.) of oily and/or waxy soil from a hard surface when compared with the Percentage Soil Removal of an equivalent cleaning formulation which does not comprise the solvent additive.

14. A combination of:

a. an alcohol ethoxylate fatty acid ester comprising the reaction product of a $C_4$ to $C_8$ alcohol, 1 to 9 mols of ethylene oxide and a $C_8$ to $C_{12}$ fatty acid and having a total number of carbon atoms from 16 to 36; and b. an alcohol ethoxylate comprising the reaction product of a $C_6$ to $C_{14}$ alcohol and 1 to 12 mols of ethylene oxide;

present in a cleaning formulation, wherein the alcohol ethoxylate fatty acid ester has a water solubility of less than 1 wt % in deionised water at 20° C. and the alcohol ethoxylate improves the dispersion and/or dissolution of the alcohol ethoxylate fatty acid ester in the cleaning formulation.

* * * * *